United States Patent [19]

Fratty

[11] 4,261,031

[45] Apr. 7, 1981

[54] RIBBED LENSES FOR HEADLAMPS

[75] Inventor: Hector Fratty, Boulogne, France

[73] Assignee: Cibie Projecteurs, Bobigny, France

[21] Appl. No.: 18,036

[22] Filed: Mar. 6, 1979

[30] Foreign Application Priority Data

Mar. 10, 1978 [FR] France ..... 78 06988

[51] Int. Cl.[3] ..... F21M 3/04

[52] U.S. Cl. ..... 362/336; 362/338; 362/340

[58] Field of Search ..... 362/336-340, 362/309

[56] References Cited

FOREIGN PATENT DOCUMENTS 813697 5/1959 United Kingdom ..... 362/337

*Primary Examiner*—John K. Corbin
*Assistant Examiner*—Bruce Y. Arnold
*Attorney, Agent, or Firm*—Alan H. Levine

[57] ABSTRACT

A motor vehicle headlamp lens has two zones A1 and B containing ribs of different width to produce different amounts of lateral spreading of the headlamp beam. Between these zones a transition zone A2 is provided where a gradual change in the width of the ribs occurs. In the transition zone there are provided novel separating surfaces between the ribs having one surface at an angle to the general plane of the lens which act as a prism to deflect light passing therethrough in a downward direction. In zones A1 and B, and in transition zone A2 the total thickness e of the lens at the crest of any rib is constant.

3 Claims, 19 Drawing Figures

Fig.3
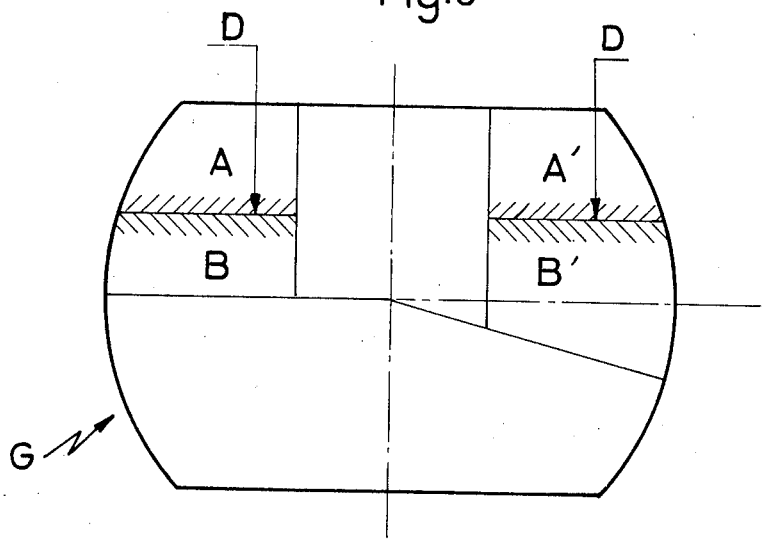
Fig.4 a
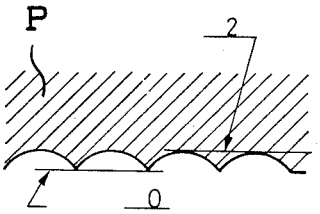
Fig.4 b
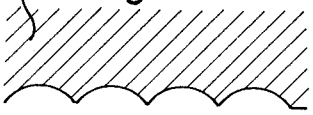
Fig.4c
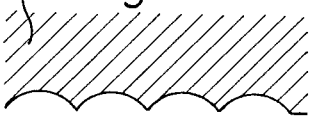
Fig.4
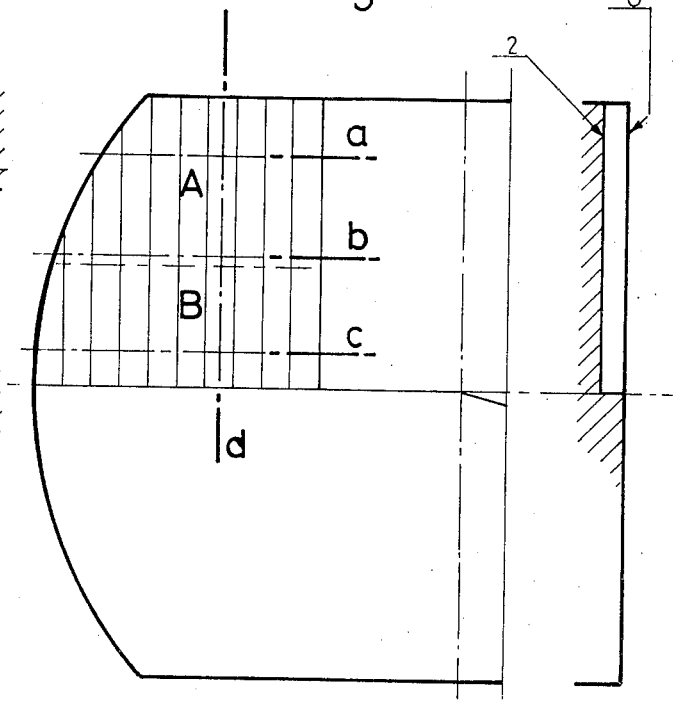
Fig.4d

RIBBED LENSES FOR HEADLAMPS

BACKGROUND

1. Field of the Invention

This invention relates to ribbed lenses for motor vehicle headlamps, and to moulding dies and methods for making such headlamp lenses.

2. The Prior Art

Such lenses usually include more than one zone of ribs, the ribs in the different zones being selected to produce different optical effects, usually differing degrees of lateral spreading, on the light passing through the lens. Where zones of ribs having different optical effects adjoin one another, there may be a discontinuity in the thickness of the lens, and this may produce disturbances in the pattern of illumination produced by the headlamp.

The way in which such discontinuities in thickness can arise will now be explained in more detail, with reference to FIGS. 1 to 3 of the accompanying drawings, of which:

FIG. 1 is a front view of the reflector of a generally rectangular headlamp;

FIG. 1*a* is a vertical axial section of the reflector of FIG. 1;

FIG. 2 shows, somewhat diagrammatically, the projection, on a screen, of the beam which would be produced by the reflector of FIG. 1 if no lens were used;

FIG. 3 is a front view of a previously-proposed front lens for a headlamp incorporating the reflector of FIG. 1.

The headlamp taken as an example is of the type comprising a generally paraboloidal reflector R, a lamp having two filaments $F_c$ (dipped-beam filament) and $F_r$ (main-beam filament) which are respectively situated in front of and behind the focal point of the reflector, and a front lens G which closes the front aperture O of the reflector R. The purpose of the lens G is to provide a correct distribution of the light from the filaments $F_c$ or $F_r$, while producing a dipped beam which, at its upper limit (the cut-off) has a sharp transition from a well-illuminated zone to a zone containing as little light as possible.

In addition to its paraboloidal reflecting surface, the reflector R in FIG. 1 is bounded by two flat portions $J_1$ and $J_2$ to define a front opening O of generally rectangular contour.

The zones of the reflector marked as 1, 2, 3 and 4 in FIG. 1 would give rise to the portions I, II, III and IV of the projection of the beam of light onto a plane 25 meters away from the headlamp as shown in FIG. 2, if the beam were not modified by the front lens G.

To avoid excessive light on the ground and in order to produce a wide beam, the lens G has ribs which spread out considerably the beam of light from the zones 1 and 2. On the other hand, the lens spreads the light from the zones 3 and 4 only slightly in order to give a good concentration of light beneath the cut-off.

As will be seen from FIG. 3, the lens G must therefore necessarily contain zones of ribs of different characteristics; the zones A and A′ have ribs of different deflecting effects from those in the zones B and B′. The difference in deflecting effect dictates differences in the cross-sections of the ribs, since the deflecting effect of the ribs varies in proportion to their height and in inverse proportion to their relative spacing. Where the two zones A and B or A′ and B′ meet, along the line D, considerable lens moulding defects can occur owing to the differences in thickness between the zones A and B or A′ and B′.

Moulding defects such as those at D are normally present in all lenses produced by moulding, wherever they comprise adjacent zones of ribs of differing characteristics. These defects produce defects in the illumination pattern, for example, blurred outlines in respect of the zones I and II.

One proposal for overcoming this difficulty is disclosed in French Pat. No. 1,187,443 (Auteroche). In this prior proposal, ribs are used having surfaces which appear part-circular in a cross-section of the ribs. Adjacent ones of the ribs are separated, along part of their length, by surfaces which appear generally flat and parallel to the general plane of the lens in such a cross-section. By virtue of this separation of adjacent ribs, the width of the ribs can vary smoothly from one part of their length to another; their depth can also vary in a corresponding manner. In the prior proposal, however, the thickness of the lens, as measured at the centre of any one rib, varies along the length of that rib, being greater where the rib is of greater width, while the thickness of the lens, as measured in the separating surfaces, is constant along the length of each separating surface.

It is an object of the invention to provide a ribbed lens for a headlamp for a motor vehicle, which lens can easily be produced, without optical defects, by moulding.

It is another object of the invention to provide a die for moulding such a lens, which can be shaped with a minimal number of shaping operations.

It is another object of the invention to provide a ribbed lens for a headlamp for a motor vehicle, which lens both spreads the light which passes through the ribs, and, where the ribs are not contiguous with one another, deflects light passing therethrough as if the light were passing through a prism.

SUMMARY OF THE INVENTION

According to one aspect, the invention provides, in a lens for a headlamp for a motor vehicle, which lens has a surface having a series of ribs, the said ribs being formed by surfaces which appear curved when the said ribs are seen in cross-section, and adjacent ones of the said curved surfaces being separated from one another, in one zone of the said lens, by separating surfaces which, at least when seen in a cross-section transverse to the said ribs, appear flat and parallel to the general plane of the said lens, the width of the said curved surfaces varying, without discontinuity, between the said one zone of the said lens and a second zone of the said lens, with a corresponding smooth variation in the depth of the said ribs, whereby the light-spreading effect of the said ribs varies from the said one zone to the said second zone, the improvement comprising: so forming the said ribs that the thickness of the said lens, as measured at points spaced along the length of any one of the said ribs, all the said points lying at the same position on the cross-section of the said one rib, is substantially constant, while the thickness of the said lens, as measured at points on the said separating surfaces of the said lens, varies along at least a part of the length of the said ribs, whereby at least a part of the said separating surfaces cooperate with the opposite surface of the said lens to act as a prism, to deflect light passing therethrough.

According to another another aspect, the invention provides, in a die for moulding a lens for a headlamp for a motor vehicle, which die has a moulding surface having a series of rib impressions, the said rib impressions being formed by surfaces which appear curved when the said rib impressions are seen in cross-section, and adjacent ones of the said curved surfaces being separated from one another, in one zone of the said moulding surface, by separating surfaces which, at least when seen in a cross-section transverse to the said rib impressions, appear flat and parallel to the general plane of the said moulding surface, the width of the said curved surfaces varying, without discontinuity, between the said one zone of the said moulding surface and a second zone of the said moulding surface, with a corresponding smooth variation in the depth of the said rib impressions, the improvement comprising: so forming the said rib impressions that a line extending lengthways along one of the said rib impressions, at a given position on the cross-section of the said one rib impression, lies parallel to the general plane of the said moulding surface, while the said separating surfaces lie at an angle to the general plane of the said moulding surface, along at least a part of the length of the said rib impressions.

According to another aspect of the invention, a method of making a die for moulding a lens for a headlamp for a motor vehicle comprises the following steps:

(i) forming a series of concave rib impressions in a moulding surface of the said die, the root of each of the said rib impressions lying at a single predetermined level along the length of the said rib impression; and (ii) removing material from the surface of the said die to a second predetermined level, whereby adjacent ones of the said rib impressions are separated by surfaces at the said second predetermined level, the said second predetermined level varying, without discontinuity, along at least part of the length of the said rib impressions, whereby the width and depth of each rib impression varies smoothly along the said part of the length of the said rib impressions.

According to yet another aspect of the invention, a method of making a die for moulding a lens for a headlamp for a motor vehicle comprises the following steps:

(i) forming a series of concave rib patterns in a pattern surface of a machining pattern, the root of each of the said rib patterns lying at a single predetermined level along the length of the said rib pattern;

(ii) removing material from the surface of the said machining pattern to a second predetermined level, whereby adjacent ones of the said rib patterns are separated by surfaces at the said second predetermined level, the said second predetermined level varying, without discontinuity, along at least a part of the length of the said rib patterns, whereby the width and depth of each rib pattern varies smoothly along the said part of the length of the said rib patterns; and (iii) when both steps (i) and (ii) have been carried out, machining the said die by a copying process using the said machining pattern as a pattern, the said die being thereby machined to a shape complementary to that of the said machining pattern.

For example, the die may be machined by spark erosion machining, using the pattern as an electrode.

BRIEF DESCRIPTION OF THE DRAWINGS

The invention may be carried into practice in various ways, but two specific embodiments will now be described by way of example, with reference to FIGS. 1, 1*a*, 2 and 4 to 6 of the accompanying drawings. In the drawings:

FIGS. 1 to 3 have already been described; FIG. 3 relates to a previously-proposed front lens for a headlamp;

FIG. 4 shows a stage in the manufacture of a die for producing a lens embodying the invention, being a front view of the partially machined die;

FIGS. 4*a* to 4*d* are sections of the partially machined die, taken on the planes a to d in FIG. 4;

FIGS. 4 and 5 relate to the production of a lens having convex ribs, which act as converging lenses. The corresponding moulding die must therefore have concave rib impressions. As with the lens of FIG. 3, the lens is to have two ribbed zones A and B.

In this example it will be assumed that theoretical calculations indicate that the ribs in zone 8 should give a maximum lateral deflection of ±3°, while the ribs in zone A should give a maximum lateral deflection of ±10°. Assuming a 6 mm pitch, this results in 9 mm radius ribs for zone A and 30 mm radius ribs for zone B; alternatively, the ribs in zone 8 could be of 9 mm radius, but then the curved portion of each rib would be only 2 mm wide, so that a flat area 4 mm wide is present between each pair of curved portions.

With ribs of these dimensions there will be a maximum difference in thickness of about 0.4 mm between some parts of zone A and the corresponding parts of zone B. The die of FIGS. 4 and 5 provides a gradual transition between these parts of different thickness; to achieve this, the die is manufactured in the following manner:

In a first stage, the zones A and B of the die P are machined to have concave ribs of 9 mm radius with a 6 mm pitch; these ribs extend through both zones A and B without any discontinuity. FIGS. 4 to 4*d* illustrate the die after this machining operation. A lens produced from this die would produce a maximum lateral deflection of ±10° of the light passing through both the zones A and B.

In a second machining operation, the crests of the ribs within the zone B are machined away by about 0.4 mm, so that the parts of the ribs which would otherwise produce a deflection in excess of ±3° are removed; FIG. 5*c* illustrates the section of the resulting ribs. This machining away of the crests is continued into the zone A, but the amount of material which is removed from the crests diminishes steadily to zero at a height H above the bottom of the zone A. Thus, as illustrated in FIG. 5, the zone A can be regarded as being divided into an upper zone $A_1$ in which the curved portions of the ribs are contiguous with one another, and a lower, transition, zone $A_2$ in which the curved portions of the ribs are separated by flat portions. These flat portions lie at an angle $\alpha$ to the general plane of the die (FIG. 5*d*) where $$\alpha = (0.4 \text{ mm}/H \text{ mm})$$

The lines 0, 1 and 2 on the drawings indicate, respectively, the plane of the crests of the ribs before the second machining operation, the plane of the flat portions between the curved surfaces of the ribs in the zone B in the completed die, and the plane of the roots of the ribs of the die.

Figure 1:
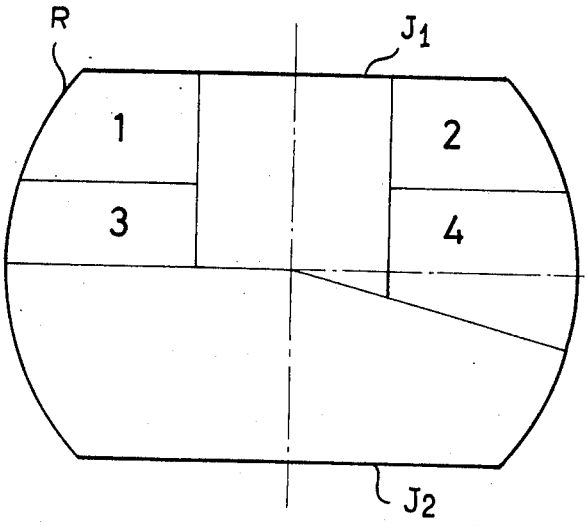
Figure 1A:
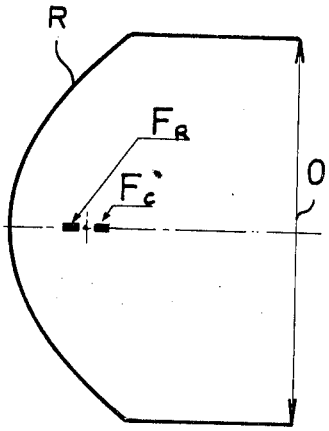
Figure 2:
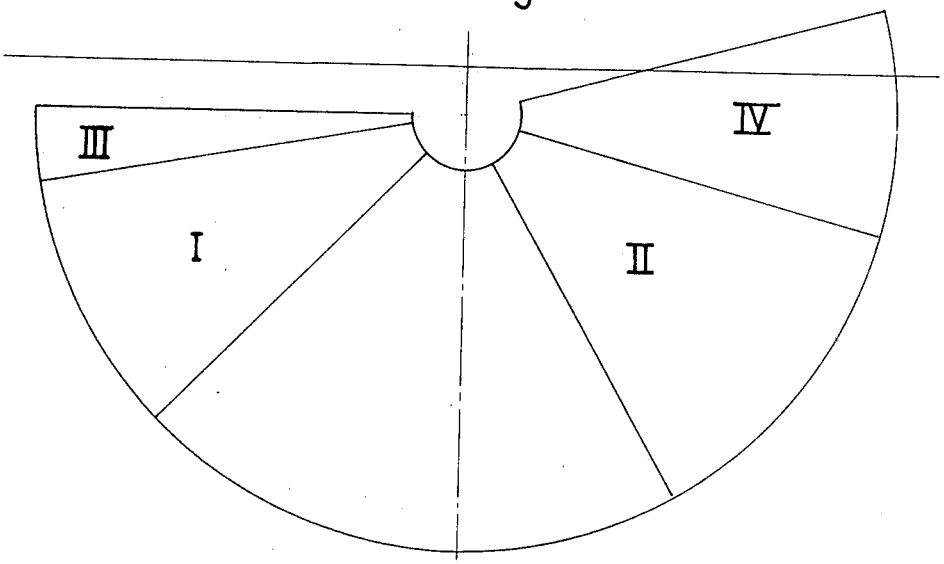
Figure 5A:
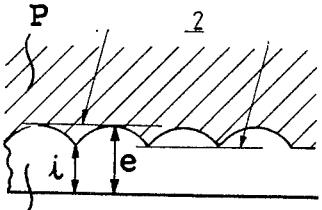
FIGS. 5*a* to 5*d* are sections of the completed die of FIG. 5, taken on the planes a to d in FIG. 5; the lens produced with such a die is also shown in these Figures.
Figure 5B:
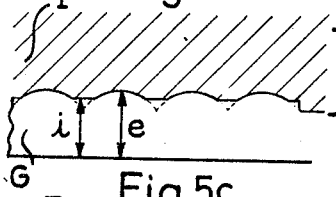
Figure 5C:
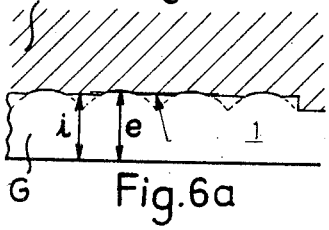
Figure 5:
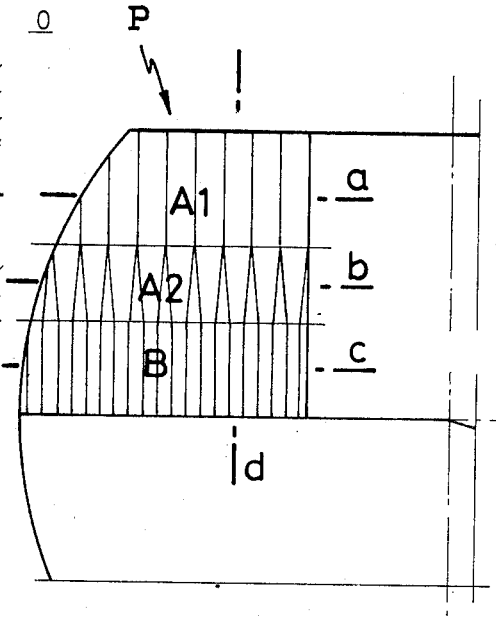
FIG. 5 is a front view of the die of FIG. 4 after machining has been completed.
Figure 5D:
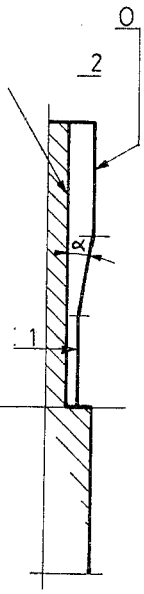

FIGS. 5*a* to 5*c* also show the lens G produced by such a moulding die.

A distinguishing feature of this lens is that the total thickness e of the lens, at the crest of the ribs of the lens, is constant both in the two zones $A_1$ and B and in the transitional zone $A_2$. On the other hand, in the flat portions produced in the second machining operation, the thickness i of the lens varies continuously from one end of the transition zone $A_2$ to the other. This variation in the thickness of the lens causes these portions of the lens to act as prisms, producing a downward deflection which is superimposed on the lateral dispersion effect of the ribs.

Thus, the lens produced spreads the headlamp beam considerably in one zone A, but only to a small degree in an adjacent zone B, and this is achieved without having any break in thickness at the separation between the two parts. Also, the vertical deflecting effect which occurs in the zone $A_2$ produces an advantageous lowering of the beam. Finally, the machining operations required in manufacturing the die are quite straightforward.

Figure 6A:
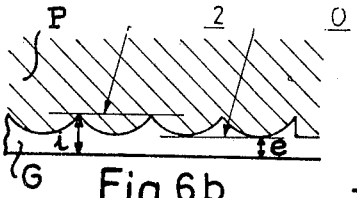
FIGS. 6 to 6*d* are views similar to FIGS. 5 to 5*d* of another die embodying the invention.
Figure 6B:
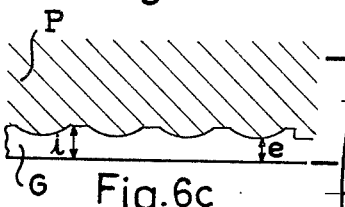
Figure 6C:
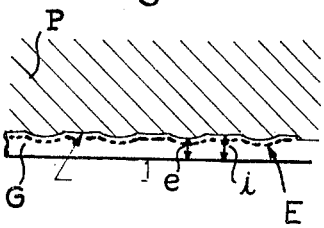
Figure 6:
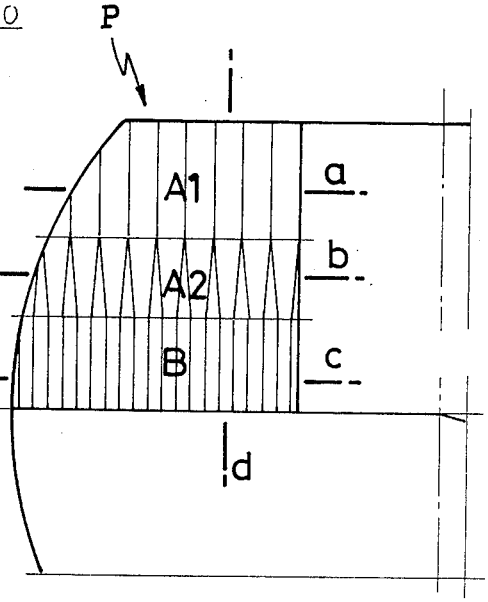
Figure 6D:
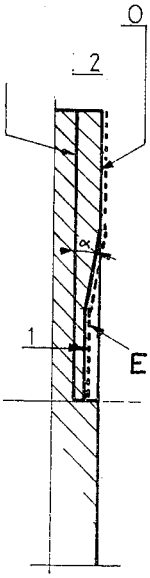

The example described with reference to FIGS. 4 and 5 produces a lens with convex ribs, which have the effect of converging lenses. To produce a lens with concave ribs, to act as diverging lenses, a die is required which has convex ribs. A die P of this kind is shown in FIGS. 6 to 6*d;* this die is of complementary shape to the die of FIGS. 5 to 5*d.* In FIGS. 6*a* to 6*d,* the line O indicates the plane of the crests of the ribs in all three zones, $A_1$, $A_2$ and B, the line 1 indicates the plane of the flat portions which form the roots of the ribs in the zone B, and the line 2 indicates the roots of the ribs in the zone $A_1$.

As in the example of FIG. 5, the corresponding lens G (FIGS. 6*a* to 6*c*) has a constant thickness e along the centre of each rib, which is in this case the root of the rib, while its thickness i in the flat portions separating the curved rib surfaces varies. The flat portions again act as prisms, although in this example they are inclined in the opposite direction from that shown in FIG. 5.

The invention has numerous applications in motor vehicle headlamp lenses. It should also be noted that although the ribs described have a part-circular section, ribs could instead be used having a section which is only approximately circular; similarly, although the inter-rib thickness i has a linear variation in the zone $A_2$, this variation may be non-linear provided that it has no discontinuities. It will also be appreciated that, when manufacturing the die P of FIG. 5 or the electrode E of FIG. 6, the surfaces forming the flat portions in zones $A_2$ and B could be machined before the ribs are machined.

I claim:

1. In a lens for a headlamp for a motor vehicle, which lens has a surface having a series of ribs, the said ribs being formed by surfaces which appear curved when the said ribs are seen in cross-section, and adjacent ones of the said curved surfaces being separated from one another, in one zone of the said lens, by separating surfaces which, at least when seen in a cross-section transverse to the said ribs, appear flat and parallel to the general plane of the said lens, the width of the said curved surfaces varying, without discontinuity, between the said one zone of the said lens and a second zone of the said lens, with a corresponding smooth variation in the depth of the said ribs, whereby the light-spreading effect of the said ribs varies from the said one zone to the said second zone, the improvement comprising: so forming the said ribs that the thickness of the said lens, as measured at points spaced along the length of any one of the said ribs, all the said points lying at the same position on the cross-section of the said one rib, is substantially constant, while the thickness of the said lens, as measured at points on the said separating surfaces of the said lens, varies along at least a part of the length of the said ribs, whereby at least a part of the said separating surfaces cooperate with the opposite surface of the said lens to act as a prism, to deflect light passing therethrough.

2. A lens according to claim 1, wherein the said rib surfaces are convex, whereby the said ribs act as converging lenses.

3. A lens according to claim 1, wherein the said rib surfaces are concave, whereby the said ribs act as diverging lenses.

* * * * *